US012241325B2

(12) United States Patent
Zahur et al.

(10) Patent No.: US 12,241,325 B2
(45) Date of Patent: Mar. 4, 2025

(54) SIDE POCKET MANDREL FOR METERED CHEMICAL INJECTION

(71) Applicant: SAUDI ARABIAN OIL COMPANY, Dhahran (SA)

(72) Inventors: Jawad Zahur, Abqaiq (SA); Mohammed Madan, Abqaiq (SA); Saud A. Al-Shuwaier, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 11 days.

(21) Appl. No.: 18/321,496

(22) Filed: May 22, 2023

(65) Prior Publication Data

US 2024/0392639 A1 Nov. 28, 2024

(51) Int. Cl.
*E21B 23/03* (2006.01)
*E21B 37/06* (2006.01)

(52) U.S. Cl.
CPC ..... *E21B 23/03* (2013.01); *E21B 37/06* (2013.01)

(58) Field of Classification Search
CPC ..... E21B 34/10
See application file for complete search history.

(56) References Cited

U.S. PATENT DOCUMENTS 4,480,687 A * 11/1984 Terral ..... E21B 34/10 166/321
4,685,523 A * 8/1987 Paschal, Jr. ..... E21B 43/122 166/146
6,082,455 A * 7/2000 Pringle ..... E21B 43/14 166/250.15

OTHER PUBLICATIONS

Tayyab, Imran , Uddin, M. Farooq, Ahmed, Qazi I., Rehman, M. I., and Syed Qazi Azam. "Combination of Foam Assisted Lift and Gas Lift (FAGL) to De-Liquefy Gas Wells." Paper presented at the PAPG/SPE Pakistan section Annual Technical Conference, Islamabad, Pakistan, Nov. 2014.

Fakhruzan, Ahmad , Apriadi, Ferry , Septian, Meldi , Akbar, M. . . , and Unggul Wicaksono. "Injection Flow Rate Control in Multiplayer Packer Well Using Bridge Eccentric Injection Mandrel." Paper presented at the SPE/IATMI Asia Pacific Oil & Gas Conference and Exhibition, Jakarta, Indonesia, Oct. 2017.

Ghouri, Saad Ali, Ali, Imtiaz , Shah, Naseem Munawar, Ejaz, Muhtashim , and Syed Afraz Haider. "Downhole Scales Management in Mature Gas Fields." Paper presented at the PAPG/SPE Pakistan Section Annual Technical Conference and Exhibition, Islamabad, Pakistan, Dec. 2018.

* cited by examiner

*Primary Examiner* — William D Hutton, Jr.
*Assistant Examiner* — Avi T Skaist
(74) *Attorney, Agent, or Firm* — Vorys, Sater, Seymour and Pease LLP

(57) ABSTRACT

A well system includes a wellbore, production tubing extended into the wellbore and thereby defining an annulus between the production tubing and an inner wall of the wellbore, and a side pocket mandrel interposing upper and lower sections of the production tubing and including a body that provides a lateral projection extending radially outward from the body, and a pocket defined within the lateral projection. The well system further includes a chemical vessel receivable within the pocket and operable to discharge an injection fluid stored within the chemical vessel into the production tubing via one or more apertures provided in the chemical vessel.

13 Claims, 3 Drawing Sheets

SIDE POCKET MANDREL FOR METERED CHEMICAL INJECTION

FIELD OF THE DISCLOSURE

The present disclosure relates generally to downhole chemical injection and, more particularly, to a downhole injection system forming part of a side pocket mandrel and operable to inject a chemical at a known rate directly into a wellbore annulus.

BACKGROUND OF THE DISCLOSURE

Scale formation within hydrocarbon producing wells is particularly problematic as it can hinder production, and in some cases, cause the abandonment of a well. Scale formation occurs when salt precipitates out of produced water (or similarly an injected brine or water) as the wellbore experiences changes in temperature and pressure. The scale coats the interior and exterior surfaces of wellbore tubulars, which can impede fluid flow paths. Scale can also adhere to the face of the formation reservoir, and as a result, the natural flow of the reservoir fluid is slowed as the scale decreases the porosity and permeability within the near-wellbore region of the reservoir. Reduced reservoir permeability, in combination with a restricted tubular flow path, results in reduced production that requires remedial operations or potentially, if left untreated, well abandonment.

Chemical injection is a commonly utilized method to treat scale or other issues that may hinder production. Current methods of chemical injection (e.g., bullheading) can be difficult to control or meter and often result in formation damage requiring further remedial operations. Other commonly used chemical injection methods can be costly requiring large amounts of specialized equipment (e.g., chemical injection lines and chemical injection mandrels) and personnel to carry them out.

An efficient chemical injection method that is controllable, less costly and provides little resultant formation damage is desirable.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellbore, a production tubing extended into the wellbore and thereby defining an annulus between the production tubing and an inner wall of the wellbore. The well system may further include a side pocket mandrel interposing upper and lower sections of the production tubing. The side pocket mandrel may include a body that provides a lateral projection extending radially outward from the body, a pocket defined within the lateral projection and a chemical vessel receivable within the pocket and operable to discharge an injection fluid stored within the chemical vessel into the production tubing via one or more apertures provided in the chemical vessel.

According to an embodiment consistent with the present disclosure, a method may include conveying a chemical vessel into production tubing extended into a wellbore from a well surface, the chemical vessel having an injection fluid stored therein. The method may further include locating a side pocket mandrel interposing upper and lower sections of the production tubing, the side pocket mandrel providing a body that provides a lateral projection extending radially outward from the body and a pocket defined within the lateral projection. The method may include receiving the chemical vessel in the pocket and discharging the injection fluid into the production tubing via one or more apertures provided in the chemical vessel.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
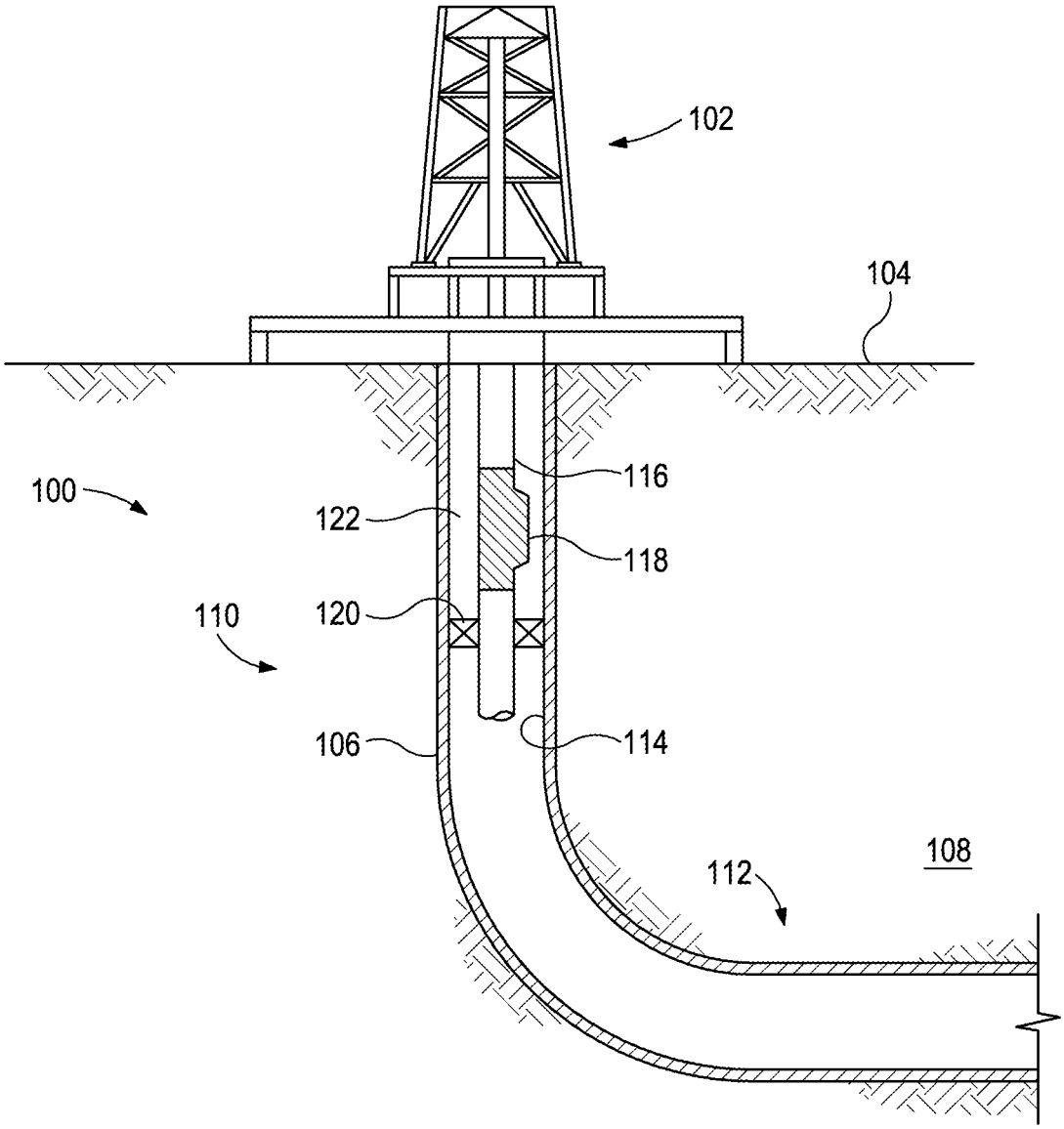
FIG. 1 is a schematic diagram of an example well system, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the downhole injection of fluids into a wellbore and, more particularly, to an injection system operable to inject a chemical directly from a side pocket mandrel into an extension of production tubing. The chemical injection treatments described herein may be targeted and tailored to address the needs and requirements of a wellbore and equipment deployed within the wellbore. More specifically, the present disclosure describes a chemical injection system that may be employed within a hydrocarbon producing wellbore in which production tubing extended into the wellbore includes one or more side pocket mandrels. The chemical injection system includes a removable, pressurized container or vessel that injects chemicals directly into the production tubing from its place of containment within a side pocket mandrel.

The presently disclosed chemical injection systems may prove advantageous for a variety of reasons. For example, implementation of such systems eliminates the need for chemical injection lines or bullheading as a means to inject the chemicals into the well, the well annuli and/or the formation. Moreover, the chemical injection systems described herein do not induce near-wellbore formation damage, nor do they induce potential tubing movement and or shrinkage. Furthermore, the systems described herein may be advantageous in facilitating targeted treatment, which cannot be accomplished via conventional methods and systems.

FIG. 1 is a schematic diagram of an example well system 100 that may employ one or more principles of the present disclosure, according to one or more embodiments. As illustrated, the well system 100 may include a rig 102 positioned on a well surface 104, e.g., the Earth's surface, and extending over and around a wellbore 106 that penetrates a subterranean formation 108. The rig 102 may be a drilling rig, a completion rig, a workover rig, or the like. In some embodiments, the rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any offshore, sea-based, or sub-sea application where the rig 102 may be a floating platform, a semi-submersible platform, or a subsurface wellhead installation as generally known in the art.

The wellbore 106 may be drilled into the subterranean formation 108 using any suitable drilling technique and may extend in a substantially vertical direction away from the well surface 104 over a vertical wellbore portion 110. At some point in the wellbore 106, the wellbore 106 may deviate from vertical relative to the well surface 104 and the vertical wellbore portion 110 may transition into a substantially horizontal wellbore portion 112. In at least one embodiment, the wellbore 106 may be completed by cementing a production casing 114 extending from the well surface 104 and along a portion of wellbore 106. In some applications, the production casing 114 terminates before reaching the bottom of the wellbore 106, thus creating an open-hole section of the wellbore 106 below (downhole from) the most distal end of the production casing 114. In other embodiments, the production casing 114 may be omitted from the wellbore 106 and the principles of the present disclosure may equally apply to an entirely "open-hole" wellbore environment. In yet other embodiments, the production casing 114 may extend for the entirety of the wellbore 106.

The well system 100 may further include production tubing 116 extending from the well surface 104 and concentrically arranged within the interior of the production casing 114. In some applications, the production tubing 116 may extend past the distal end of the production casing 114 and be positioned within the open-hole section of the wellbore 106. In other embodiments, the distal end of the production tubing 116 may be positioned such that it remains within the interior of the production casing 114. The production tubing 116 may be operable to receive and convey formation fluids flowing into the wellbore 106 from the formation 108. The formation fluids may comprise, for example, hydrocarbons (e.g., oil and gas) and water that migrate from a producible reservoir within the formation 108 and into the wellbore 106.

The well system 100 may further include one or more side pocket mandrels 118 (one shown) arranged within and forming part of the production tubing 116. The side pocket mandrel 118 may be arranged within the production tubing 116 at the discretion of the well operator. In at least one embodiment, the side pocket mandrel 118 may be arranged within the wellbore 106 inside the production casing 114. Alternatively, the side pocket mandrel 118 may be arranged to axially align with an open-hole section where production casing 114 has been omitted. In other embodiments, the well system 100 may include a plurality of side pocket mandrels 118, where at least one side pocket mandrel 118 aligns within an open-hole section and at least one side pocket mandrel 118 is arranged within the production casing 114. In any of the foregoing embodiments, the side pocket mandrel 118 may fluidly communicate with the interior of the production tubing 116.

In some embodiments, the production tubing 116 may be conveyed into the wellbore 106 in combination with a production packer 120 operatively coupled to the production tubing 116 at or near its distal end. In at least one embodiment, the production packer 120 may be positioned downhole from the side pocket mandrel 118. In other embodiments, the production packer 120 may be positioned uphole from the side pocket mandrel 118 without departing from the scope of this disclosure. The production packer 120 may include any of a variety of radially expandable elements and may be actuated by any of a variety of methods of actuation. The production packer 120 may be arranged within an annulus 122 defined between the production tubing 116 and the inner walls of the wellbore 106, wherein the inner walls of the wellbore 106 may be either the inner wall of the production casing 114 or the inner wall of an adjacent open-hole section of the wellbore 106. In some applications, the annulus 122 may be referred to as the tubing-casing annulus or "TCA". When activated (deployed), the expandable elements of the production packer 120 may extend radially outward to engage the inner walls of the wellbore 106 (e.g., the inner wall of the production casing 114 or the inner wall of the adjacent open-hole section) and thereby secure the lowermost portion of the production tubing 116 within the wellbore 106. Moreover, once deployed, the production packer 120 provides a fluid seal in the annulus 122 and may be operable as a mechanical well barrier to fluid flow between a producible reservoir and a portion of the annulus 122 above (uphole) of the production packer. In other embodiments, the production packer 120 may be omitted from the well system 100 entirely, and such an embodiment will not exceed the scope of this disclosure.

It will be appreciated by those skilled in the art that even though FIG. 1 depicts the side pocket mandrel 118 and the production packer 120 being arranged and operating in the vertical portion 110 of the wellbore 106, the embodiments described herein are equally applicable for use in portions of the wellbore 106 that are horizontal, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the well surface 104, and the term "distal" refers to the portion of the component that is furthest from the surface 104.

To prevent or treat scale deposition within the wellbore 106, conventional methods of treatments can be utilized that may include performing scale inhibitor squeezes. Squeezes generally entail pumping (bullheading) a chemical, such as a scale inhibitor, into the annulus 122. The scale inhibitor may be adsorbed by the exposed formation (e.g., the open-hole section; not shown). When pumping ceases and the well is put back on to production, formation fluids flow back into the wellbore 106 with the scale inhibitor, preventing the buildup or deposition of scale within the wellbore 106 and more broadly, the well system 100. The rate of flow back is only controllable by increasing or decreasing the amount of water the well produces. Permitting a higher water cut rate flows back the injected chemical at a quicker rate, dissipating the treatment faster and often requiring repeat squeeze operations which may ultimately, with the addition of more chemicals, cause formation damage to the near-bore region of the wellbore 106. Such formation damage may reduce the porosity and permeability of the near-bore region and result in an overall reduction of hydrocarbon production.

Side pocket mandrels are a commonly utilized tubular capable of receiving and retaining replaceable downhole devices, such as gas lift valves and circulation valves. Using a side pocket mandrel allows for the retrieval and replacement of valves/components without having to remove the entire production tubing 116. As an alternative to bullheading, side pocket mandrels are also used for chemical injection and, more particularly, continuous chemical injection. In such applications, the side pocket mandrel may house a chemical injection valve that is fluidly coupled to a control line that extends from the well surface 104 to the chemical injection valve. Because the injected chemicals are sourced from the well surface 104, they are injected into the control line at ambient temperature and pumped to the chemical injection valve to be discharged into the interior body of the production tubing. In such applications, the chemicals are injected at near surface temperature (i.e., the temperature of the injected chemical is much colder than the downhole temperature) and can result in movement and even shrinkage of the production tubing 116, which can cause the production tubing 116 to unseat from the production packer 120, thus resulting in a loss of well barrier integrity.

According to embodiments of the present disclosure, alternative to traditional chemical treatment of the wellbore 106, chemical injection may be controlled, targeted, and at (or near) downhole wellbore temperatures. The embodiments herein disclose the use of the side pocket mandrel 118 capable of housing a removable, pressurized chemical vessel that may discharge specified and known dosages of fluids (e.g., chemicals).

Figure 2:
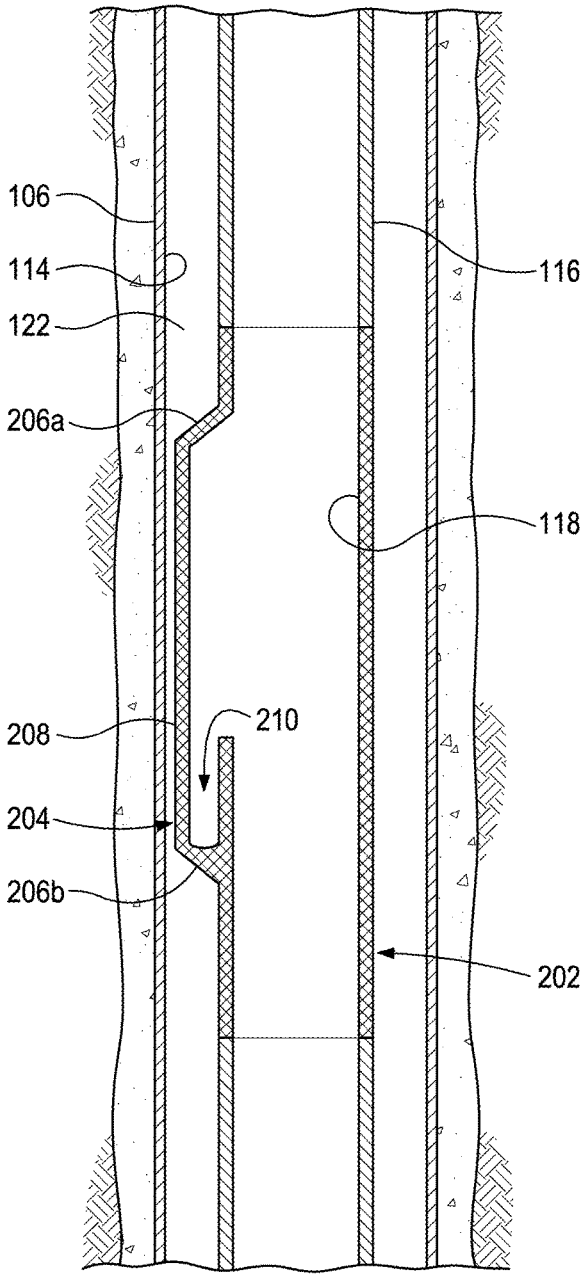
FIG. 2 is an enlarged, schematic cross-sectional side view of a portion of the well system of FIG. 1, according to one or more embodiments of the present disclosure.

FIG. 2 is an enlarged, schematic cross-sectional side view of a portion of the wellbore 106 of FIG. 1, according to one or more embodiments of the present disclosure. More particularly, FIG. 2 illustrates an enlarged view of the side pocket mandrel 118 as arranged within the production casing 114 of the wellbore 106. The side pocket mandrel 118 interposes upper and lower sections of the production tubing 116. Accordingly, opposing ends of the side pocket mandrel 118 may include matable connections (not shown) that may permit operative coupling to the production tubing 116. In at least one embodiment, the matable connection comprises threads (e.g., American Petroleum Institute (API) threads) that may threadably engage matable threads defined upon the opposing upper and lower sections of the production tubing 116. In other embodiments, the matable members of the side pocket mandrel 118 may comprise any known connection that will engage the opposing connection of the production tubing 116.

As illustrated, the side pocket mandrel 118 comprises a generally elongate, tubular body 202, portions of which align with and have the same outer circumferential dimensions as that of the production tubing 116. The body 202 may define a lateral projection 204 that extends radially outward from the body 202 and, therefore, exhibits a larger cross-sectional diameter as compared to the remaining portions of the body 202. Accordingly, the lateral projection 204 extends into the surrounding annulus 122.

As illustrated, the lateral projection 204 may include upper and lower shoulders 206*a* and 206*b* that project radially outward from the outer circumference of the body 202. In some embodiments, one or both of the shoulders 206*a,b* may extend from the outer surface of the body 202 at an obtuse (non-perpendicular) angle. This may prove advantageous in helping to avoid catching the shoulders 206*a,b* on downhole obstructions as the production tubing 116 is moved downhole or uphole within the wellbore 106.

The lateral projection 204 further provides and otherwise defines a lateral face 208, and the shoulders 206*a,b* extend between the body 202 and the lateral face 208. In some embodiments, a well operator may advance the production tubing 116 into the wellbore 106 until the lateral face 208 aligns axially with the desired portion of the wellbore 106 (e.g., inside the production casing 114 or within an open-hole section).

The lateral projection 204 may provide and otherwise define a pocket 210 that forms the interior of the lateral projection 204. As described in more detail below, the pocket 210 may be sized and otherwise configured to receive and retain a chemical vessel operable to discharge an injection fluid into the wellbore 106 and, more particularly, into the interior of the production tubing 116.

Figure 3:
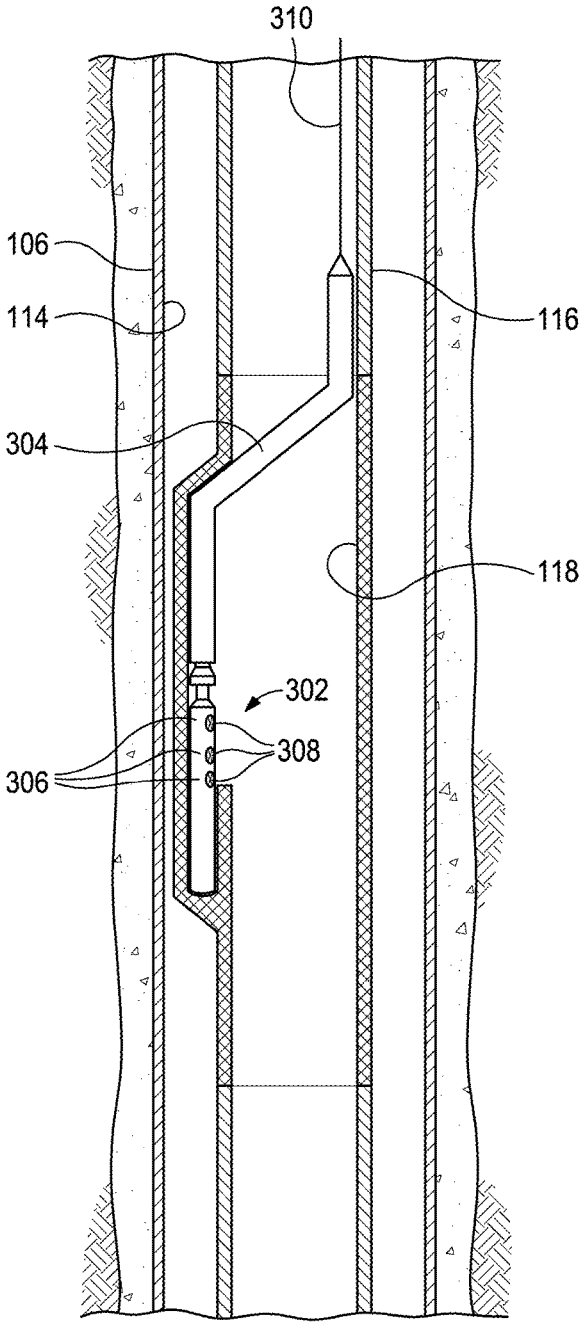
FIG. 3 is an enlarged, schematic cross-sectional side view of a portion of the wellbore of FIG. 2 depicting the progressive step of an example chemical injection operation, according to one or more embodiments of the present disclosure.

FIG. 3 is another enlarged, schematic cross-sectional side view of the wellbore 106, depicting the installation and/or removal of an example chemical vessel 302 (alternatively referred to as a "chemical bottle" or "chemical container") within the side pocket mandrel 118, according to one or more embodiments of the present disclosure. As illustrated, the chemical vessel 302 may include a generally cylindrical and elongate body sized and otherwise configured to be received within the pocket 210. The chemical vessel 302 may be configured to contain an injection fluid to be discharged into the interior of the production tubing 116. The injection fluid may comprise, for example, a chemical, a mixture of chemicals, or any combination thereof. The injection fluid may comprise a particular volume and composition dictated by the operator and applicable to the needs of the wellbore 106.

In at least one embodiment, the injection fluid contained within the chemical vessel 302 may comprise a scale inhibitor capable of preventing the buildup of scale in the interior of the production tubing 116, as well as on inner walls of the wellbore 106 and/or the exterior of the production tubing 116. In other embodiments, the injection fluid may comprise a chemical treatment including, but not limited to, a corrosion inhibitor, an asphaltenes inhibitor, a wax inhibitor, an anti-foamer, a demulsifier, a surfactant, and any combination thereof. In some embodiments, the injection fluid may be pressurized within the chemical vessel 302 such that the injection fluid may be discharged (propelled) from the chemical vessel 302 at a known flow rate.

In some embodiments, the chemical vessel 302 may provide and otherwise define one or more apertures 306 through which the injection fluid may be discharged from the chemical vessel 302. In at least one embodiment, the one or more apertures 306 may comprise metered orifices configured to restrict or "meter" fluid communication. In such an embodiment, the metered orifice may comprise a known diameter (flow path), through which the injection fluid is discharged from the chemical vessel 302 at a known flow rate. In other embodiments, one or more of the apertures 306 may comprise a one-way check valve operable to permit a known flow rate of the injection fluid through the apertures 306, while simultaneously preventing backflow of fluids from the production tubing 116 and into the chemical vessel 302. Other embodiments may include apertures 306 that comprise nozzles actuatable by differential pressure. In yet other embodiments, the apertures 306 may comprise selectively actuatable valves configured to be opened or closed based on command signals sent from the well surface 104 (FIG. 1) or another location. In such embodiments, the actuatable valves may be selectively opened to a desired degree and thereby permit a known flow rate of the injection fluid.

In at least one embodiment, the chemical vessel 302 may be removably coupled to the side pocket mandrel 118, and thus configured to be deployed and retrieved while the side pocket mandrel 118 remains in place within the wellbore 106. In such embodiments, the chemical vessel 302 may be releasably coupled to a running tool 304 operable to selectively couple and decouple from the chemical vessel 302. The running tool 304 may be operatively coupled to and conveyed into the wellbore 106 by means of a conveyance 310 such as, but not limited to, wireline, slickline, digital slickline, coiled tubing, or any combination thereof. Deployment (and similarly, retrieval) by wireline or slickline is advantageous over traditional bullheading operations because of the relative simplicity of surface equipment utilized, as well as the speed with which a slickline operation may be carried out. A faster operation may result in reduced non-productive time and as a result, less cost.

In FIG. 3, the running tool 304 is depicted as a kickover tool, but could alternatively comprise other types of downhole tools capable of coupling to and decoupling from the chemical vessel 302 and running the chemical vessel 302 into and out of the wellbore 106.

To install the chemical vessel 302 in the side pocket mandrel 118, the running tool 304 may convey the chemical vessel 302 to the side pocket mandrel 118 within the production tubing 116. Upon reaching the side pocket mandrel 118, the chemical vessel 302 may locate and be received within the pocket 210. In at least one embodiment, the running tool 304 may be manipulated and otherwise operable to position the chemical vessel 302 within the pocket 210 such that the apertures 306 align to face the interior of the production tubing 116 to allow discharge of the injection fluid from the chemical vessel 302. Once the chemical vessel 302 is properly positioned and aligned, the running tool 304 may be decoupled (disconnected) from the chemical vessel 302 and retrieved back to the well surface 104 (FIG. 1) on the conveyance 310.

In some embodiments, decoupling the running tool 304 from the chemical vessel 302 may actuate and otherwise activate the apertures 306 to an open position, thereby resulting in an automatic and metered release of the injection fluid contained within the chemical vessel 302. In at least one embodiment, however, one or more of the apertures 306 may include a metered orifice 308, as described above. In such embodiments, the injection fluid may pass through the metered orifice 308 at a known flow rate and be discharged into the production tubing 116. In embodiments where the metered orifice 308 comprises a one-way check valve or the like, the pressurized flow of the injection fluid discharged from the chemical vessel 302 may open the one-way check valves arranged within the apertures 306, thereby allowing the injection fluid to be discharged into the wellbore 106 and, more particularly, into the production tubing 116. In such embodiments, when the pressurized flow of the injection fluid from the apertures 306 ceases, the one-way check valves will automatically close, thereby creating a barrier to fluid flow from the production tubing 116 into the chemical vessel 302.

In other embodiments, the release of the injection fluid from the chemical vessel 302 may be via any known actuation mechanism including but not limited to differential pressure nozzles, timed release, telecommunication methods that may be wired or in the alternative, wireless, and radio frequency identification (RFID) activation.

Regardless of the actuation mechanism, the injection fluid may be discharged into the well system 100 (FIG. 1) at or near downhole temperatures or otherwise at a temperature that is at or near the temperature within the wellbore 106 where the side pocket mandrel 118 is located. In contrast to conventional chemical injection by means of a control line, the chemicals contained within the chemical vessel 302 may be gradually exposed to and match the downhole temperature such that the injection fluid may be discharged from the chemical vessel 302 at or near downhole temperatures. Similarly, wherein the actuation method is timed release or some other on-demand communication methodology, the operator may ensure that chemical injection occurs when the contained chemical has (or should have) reached the downhole temperature. In either embodiment, injection of the injection fluid at or near the downhole temperature of the wellbore 106 reduces the potential of shifting of the production tubing 116 or unseating from the production packer 120 (FIG. 1).

Once the injection fluid has been discharged from the chemical vessel 302 and the chemical vessel 302 is otherwise "depleted," the chemical vessel 302 may be extracted from the wellbore 106 and refilled and re-pressurized for future use. To retrieve the chemical vessel 302, the running tool 304 may be extended into the production tubing 116 on the conveyance 310 and advanced downhole to locate the chemical vessel 302. Upon locating the chemical vessel 302, the running tool 304 may be operatively coupled to the chemical vessel 302.

In some embodiments, coupling the running tool 304 to the chemical vessel 302 may disengage the chemical vessel 302 from the pocket 210. In other embodiments, the running tool 304 may have to be manipulated to disengage the chemical vessel 302 from the pocket 210. In yet other embodiments, the chemical vessel 302 may be disengaged from the pocket 210 by coupling the running tool 304 to the chemical vessel 302 and pulling in the uphole direction with the running tool 304. Once the chemical vessel 302 is removed from the pocket 210, the conveyance 310 may be retracted uphole to return the chemical vessel 302 to the well surface 104 (FIG. 1).

Figure 4:
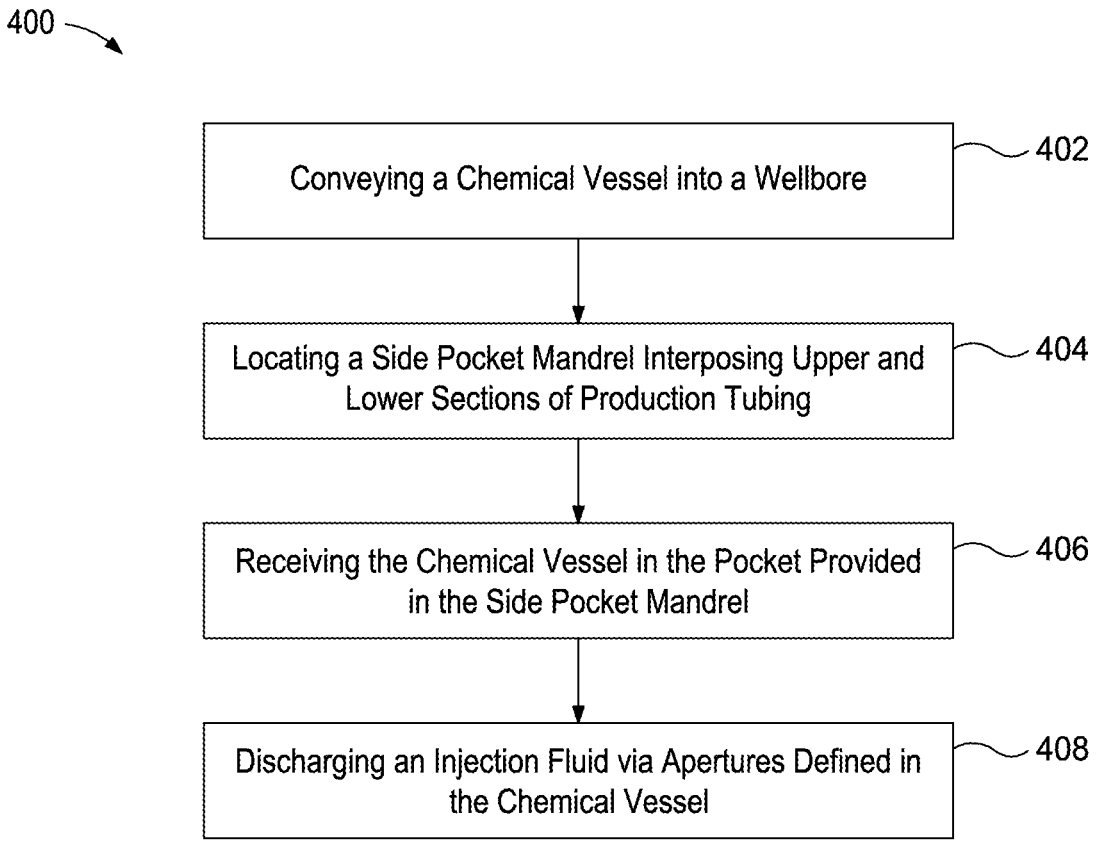
FIG. 4 is a schematic flowchart of an example chemical injection method, according to one or more embodiments.

FIG. 4 is a schematic flowchart of an example chemical injection method 400, according to one or more embodiments. The method 400 may include conveying a chemical vessel into a wellbore, as at 402. The chemical vessel may be conveyed into the wellbore within production tubing extended into the wellbore, and the chemical vessel may have an injection fluid stored therein. The wellbore may be at least partially lined with production casing extending from the surface as well, and the production tubing may extend within the interior of the production casing. The chemical vessel may be conveyed downhole until locating a side pocket mandrel interposing upper and lower sections of the production tubing, as at 404. The side pocket mandrel may include a body that provides a lateral projection extending radially outward from the body and defining a lateral face, a pocket defined by the lateral projection, and operable to receive and contain the chemical vessel.

The method 400 may further include receiving the chemical vessel in the pocket, as at 406, and discharging the injection fluid into the production tubing via the one or more apertures defined within the chemical vessel, as at 408. In some embodiments, the injection fluid is discharged at a temperature of the wellbore where the side pocket mandrel is located. In some embodiments, once the injection fluid is discharged from the chemical vessel, the depleted chemical vessel may then be removed from the pocket and returned to the well surface. In at least one embodiment, the chemical vessel may be re-filled with additional injection fluid and conveyed back downhole to be re-deployed within the pocket of the side pocket mandrel.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

production tubing extendable into a wellbore, the production tubing defining a first bore;

a side pocket mandrel interposing upper and lower sections of the production tubing and comprising:

a body that provides a lateral projection extending radially outward from the body, the body including an inner surface defining a second bore extending through the body and in communication with the first bore; and a pocket defined by the inner surface of the body within the lateral projection, wherein the pocket is a blind bore having an open end and a closed end; and a chemical vessel insertable into the pocket through the open end, the chemical vessel being operable to discharge an injection fluid stored within the chemical vessel into the production tubing via one or more apertures provided in the chemical vessel.

2. The well system of claim 1, wherein at least one of the one or more apertures comprises a metered orifice selected from the group consisting of an unobstructed hole exhibiting a known diameter, a one-way check valve, a selectively actuatable valve, a differential pressure nozzle, and any combination thereof.

3. The well system of claim 1, wherein the injection fluid is selected from the group consisting of a scale inhibitor, a corrosion inhibitor, a wax inhibitor, an asphaltenes inhibitor, an anti-foamer, a surfactant, and any combination thereof.

4. The well system of claim 1, further comprising:

a running tool operable to releasably couple and decouple from the chemical vessel; and a conveyance operatively coupled to the running tool and operable to convey the running tool and the chemical vessel into the production tubing the to insert the chemical vessel in the pocket and further operable to retract out of the production tubing to disengage the chemical vessel from the pocket.

5. The well system of claim 4, wherein in the running tool comprises a kickover tool.

6. The well system of claim 4, wherein the conveyance is selected from the group consisting of wireline, slickline, coiled tubing, and any combination thereof.

7. The well system of claim 1, wherein the production tubing extends past a distal end of production casing and the side pocket mandrel is axially aligned with a cased hole section of the wellbore that the production tubing and the production casing are disposed within.

8. The well system of claim 1, wherein the production tubing extends past a distal end of production casing and the side pocket mandrel is axially aligned with an open-hole section of the wellbore that the production tubing and the production casing are disposed within.

9. A method, comprising:

conveying a chemical vessel connected to a running tool from a well surface into a bore of a production tubing extended into a wellbore;

conveying the chemical vessel through the bore of the production tubing and into a pocket defined within a lateral projection of a side pocket mandrel interposing upper and lower sections of the production tubing, the chemical vessel having an injection fluid stored therein;

disconnecting the chemical vessel from the running tool once disposed within the pocket;

discharging the injection fluid stored within the chemical vessel into the production tubing via one or more apertures provided in the chemical vessel.

10. The method of claim 9, further comprising:

depleting the injection fluid from the chemical vessel;

re-connecting the running tool to the chemical vessel;

withdrawing the chemical vessel from the pocket as connected to the running tool and conveying the chemical vessel to the well surface.

11. The method of claim 9, further comprising pressurizing the injection fluid inside the chemical vessel at the well surface.

12. The method of claim 9, wherein discharging the injection fluid into the production tubing comprises discharging the injection fluid at a temperature of the wellbore where the side pocket mandrel is located.

13. The method of claim 9, wherein discharging the injection fluid into the production tubing comprises discharging the injection fluid from the chemical vessel at a known flow rate.

* * * * *